United States Patent [19]

Karakis et al.

[11] 4,103,136

[45] Jul. 25, 1978

[54] SWITCH HOUSING WITH CABLE SEAL

[75] Inventors: Thomas G. Karakis, Greendale; Clayton J. Klotz, Waukesha, both of Wis.

[73] Assignee: Allen-Bradley Company, Milwaukee, Wis.

[21] Appl. No.: 821,881

[22] Filed: Aug. 4, 1977

Related U.S. Application Data

[63] Continuation-in-part of Ser. No. 797,612, May 17, 1977.

[51] Int. Cl.[2] ..... H01H 9/04

[52] U.S. Cl. ..... 200/302; 174/23 R; 174/65 SS; 174/65 G; 174/76; 174/77 R; 277/4

[58] Field of Search ..... 200/302; 174/23 R, 23 C, 174/65 R, 65 SS, 65 G, 76, 77 R; 277/4

[56] References Cited

U.S. PATENT DOCUMENTS

| | | | |
|---|---|---|---|
| 2,287,650 | 6/1942 | Tornblom | 200/302 |
| 2,785,251 | 3/1957 | Cassidy | 200/302 X |
| 2,814,703 | 11/1957 | Martin | 200/302 |
| 2,859,313 | 11/1958 | Connelly | 200/302 |
| 2,915,614 | 12/1959 | Loomis | 200/302 X |
| 3,200,208 | 8/1965 | Mastney | 200/302 X |
| 3,328,512 | 6/1967 | Lembke et al. | 174/20 X |
| 3,781,456 | 12/1973 | Knowles et al. | 174/23 R |

FOREIGN PATENT DOCUMENTS

| | | | |
|---|---|---|---|
| 1,246,653 | 10/1960 | France | 200/302 |
| 1,090,737 | 10/1960 | Fed. Rep. of Germany | 174/23 R |

*Primary Examiner*—Robert S. Ward, Jr.
*Attorney, Agent, or Firm*—Quarles & Brady

[57] ABSTRACT

A prewired electrical switch having an attached electrical cable includes a housing which provides a cable seal which prevents fluid from traveling by capillary action from outside the housing through the electrical cable into the interior of the switch housing where the fluid can interfere with the normal operation of the switch. The cable seal is provided by a separate cable receiving section of the housing which has pockets which receive and isolate uninsulated portions of the individual electrical conductors of the cable. A non-conductive potting compound such as an epoxy resin fills the pockets and forms fluid-tight seals with the uninsulated portions of the individual conductors and adjacent insulated portions within the pocket. The potting compound also forms a fluid-tight seal with the end of the cable.

10 Claims, 5 Drawing Figures

Fig. 1
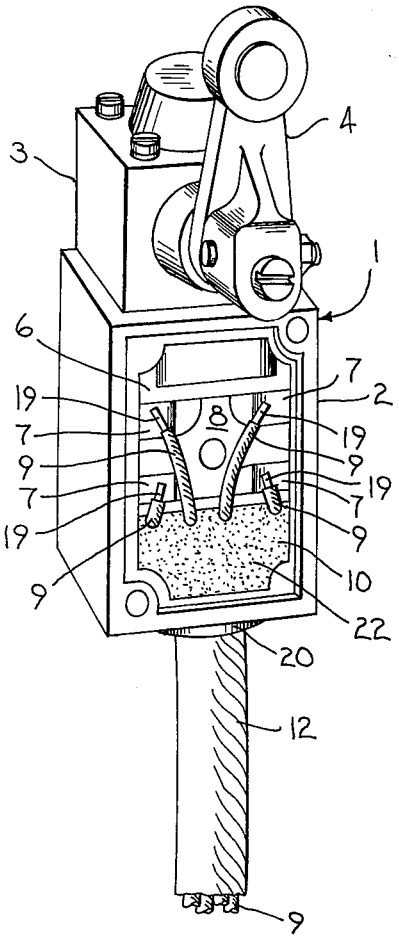
Fig. 2
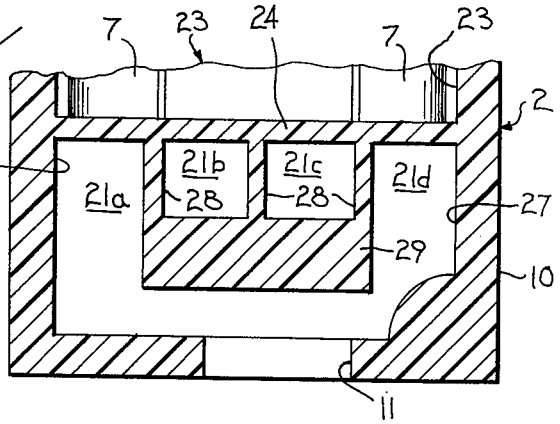
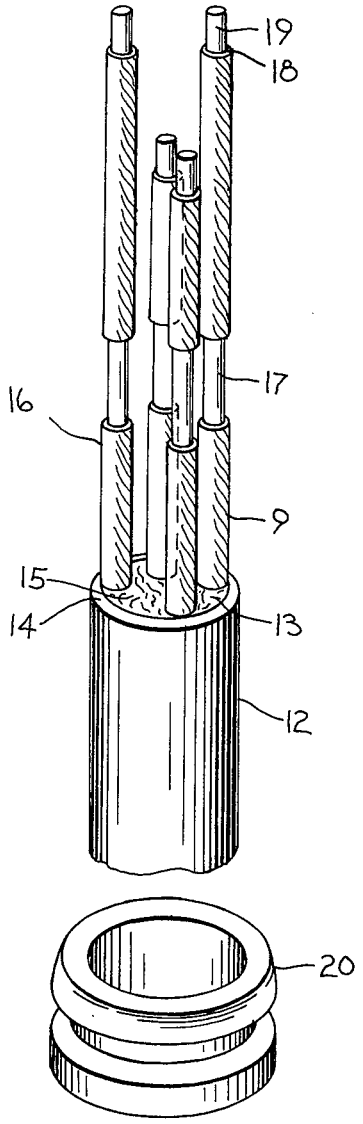
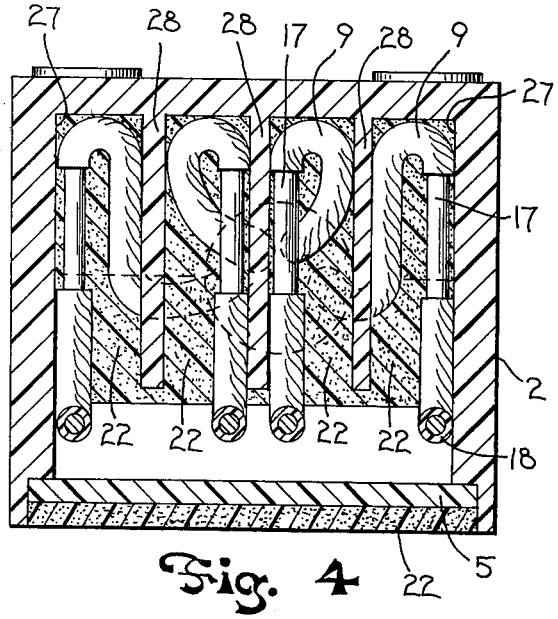
Fig. 4

SWITCH HOUSING WITH CABLE SEAL

This is a continuation-in-part of our earlier application Serial No. 797,612, filed May 17, 1977, and titled "Seal for Electrical Cable".

BACKGROUND OF THE INVENTION

This invention relates to a prewired switch housing which includes a cable seal which prevents fluid from traveling by capillary action through an attached electrical cable into the interior of the housing. More particularly, it relates to switch housings particularly adapted for use in wet or hostile environments.

In general, it is desirable to prevent fluids, such as water and oil, from entering the interior of the housings of electrical switches because such fluids can interfere with the normal operation of the switch by causing shorting, corrosion, mechanical sticking or the like. Therefore, switches which are intended for use in wet or hostile environments are usually specially designed to be fluid tight. In one type of switch intended for use in such environments a resilient gasket is interposed between the mating surfaces of the housing sections of the switch to form a fluid-tight seal. However, even switches equipped with such gaskets have not completely solved the problem as it has been found that when such switches are subjected to wet or hostile environments or when they are improperly terminated, such as in an open junction box, fluid can enter the switch housing by traveling through the electrical cable by "wicking" or capillary action.

In an attempt to provide a solution to the "wicking" problem, some cable manufacturers have produced cable with an "antiwicking" filler material interposed between the individual wires or conductors. However, the use of such filler material does not prevent the "wicking" of fluid through the individual conductors. One attempt to solve the problem of "wicking" through the individual conductors has been the development by cable manufacturers of a "water blocked" cable in which the individual conductors are packed with a jelly-like substance which prevents "wicking" through the strands. However, the approach is not without disadvantage for the preparation of the cable ends for wiring is a messy and hazardous procedure because the jelly-like substance must be removed in an acid bath.

SUMMARY OF THE INVENTION

It is the general object of this invention to provide a prewired switch housing which provides a cable seal which prevents fluids from traveling by capillary action from outside the housing through the attached electrical cable into the interior of the switch housing where the fluid can interfere with the normal operations of the switch.

It is a further object to disclose a prewired switch housing which permits the use of conventional electrical cable in wet or hostile environments.

The foregoing objects are obtained by the housing of the present invention which is highly effective and durable, although relatively simple and inexpensive.

BRIEF DESCRIPTION OF THE DRAWINGS

FIG. 1 is a perspective view of an uncovered electrical limit switch which employs the present invention;

FIG. 2 is an enlarged exploded view partially in section showing the cable receiving section of the switch, the cable and the sealing grommet prior to assembly;

FIG. 4 is a cross-sectional view through the plane 4—4 shown in FIG. 3.

DESCRIPTION OF THE PREFERRED EMBODIMENT

Figure 3:
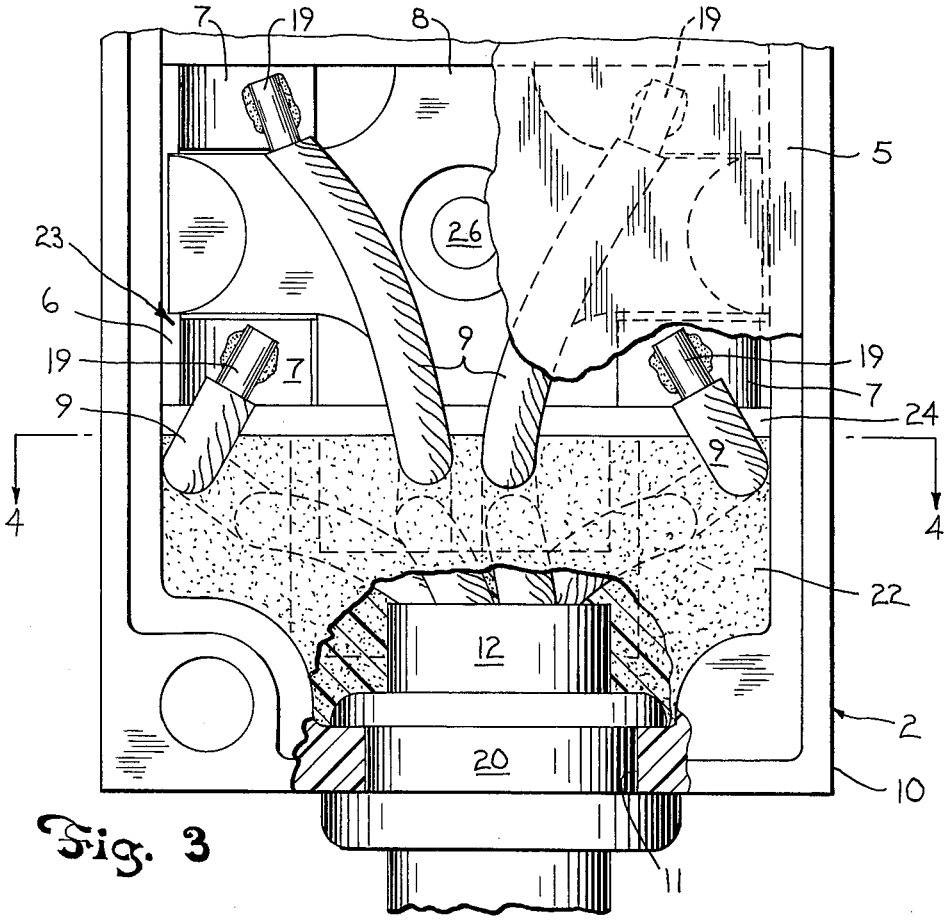
FIG. 3 is an enlarged front view partially in section of the bottom portion of the switch of FIG. 1 with the cover in place.

In our earlier application we disclosed both a method of preventing fluid from entering a switch housing via an electrical cable and novel seal assembly which could be employed with a conventional switch housing to prevent fluid from entering the housing by traveling through an attached electrical cable.

In the present application, a prewired switch is disclosed which has a specially designed switch housing which includes a separate cable receiving section having a plurality of pockets adapted to receive and isolate bare sections of the individual conductors of the electrical cable from one another and to receive a potting compound which forms fluid-tight seals with the bare and insulated sections of the conductors thus preventing fluid from entering the main portion of the housing which contains the switch components.

The limit switch shown in the drawings is generally designated by the reference number 1, and includes a housing 2, an operating head 3 positioned atop the housing 2 and an actuating arm 4 connected to the operating head. A cover 5 (seen only in FIGS. 3, 4 and 5) has been removed in FIG. 1 to show the interior of the housing for purposes of describing the present invention.

Positioned within the housing is a contact block 6 which contains the electrical and mechanical components of the switch. All that can be seen of the contact block 6 is the electrical conductor terminals 7 and the protective cover 8 for the contact block 6. As seen in FIG. 1, electrical conductors 9 are attached to each of the terminals 7.

The electrical and mechanical components of the contact block 6 are preferably of the quick make, quick break type shown and described in detail in U.S. Pat. No. 2,791,656 which is incorporated by reference herein. The preferred contact block 6 is that currently available in the Allen Bradley Company oil tight switch Model 802T.

An operating plunger (not shown) leads from the operating head 3 downward into the interior of the housing 2 and the pivotal movement of the actuating arm 4 causes an extension or retraction of the contact modules of the contact block 6. The limit switch described is representative of the type of switches in which the present invention can be employed.

The cable receiving section 10 of the housing 2 of the switch 1 and the cable seal will now be described in detail in connection with FIGS. 2–5.

Turning now to FIG. 2, it can be seen that the cable receiving bottom section 10 of the housing 2 is provided with an electrical cable receiving opening 11. Positioned below the opening 10 is an electrical cable 12 which has been modified for use in the present invention by removing from one end 13 the outer cover 14 and the filler 15 to expose lengths 16 of the individual electrical conductors 9. The exposed lengths 16 of the individual electrical conductors have intermediate sections 17 from which all insulation or covering 18 has been stripped. In addition, the insulation 18 has been removed from the free ends 19 of the conductors 9 so that they can be soldered or otherwise conveniently attached to the terminals 7 of the switch seen in FIG. 1. In FIG. 2 there can also be seen a grommet 20 of resilient material which is shaped to be fitted about the cable 12 and form a seal with the wall of the openings 11 as seen in FIGS. 3 and 5.

The switch shown in the drawings is assembled by inserting the exposed lengths 16 of the conductors 9 and the modified end 13 of the cable 12 into the opening 11 which contains the grommet 20. The exposed length 16 of each of the conductors 9 is then preferably folded so that the bare intermediate section 17 is within the fold. The folded portion of each of the conductors 9 is then placed in its own pocket 21 in the cable receiving section 10 of the housing. A sufficient portion of each conductor 9 is permitted to extend outside the pocket 21 so that the free end 19 can be connected to a terminal 7. The grommet 20 forms a fluid-tight seal with the outside of the cable 12 and the wall of the opening 11. The thus assembled switch is then placed back down and the cable receiving section 10 including the pockets 21 is flooded and filled with a non-conductive potting compound 22. The potting compound forms a fluid-tight seal with the insulated and uninsulated portions 17 of the conductors 9 in the pockets 21 and the exposed end 13 of the cable 12. The potting compound 22 is prevented from leaving the housing 2 through the opening 11 by the cooperation of the grommet 20 and the cable 12, and it is prevented from entering the main contact block receiving section 23 of the housing by the wall 24 which separates the cable receiving section 10 and the contact block receiving compartment 23. The potting compound 22 is then allowed to cure. Finally, the cover 5 can be secured in position closing off the interior of the housing and completing the assembly of the prewired switch.

Figure 5:
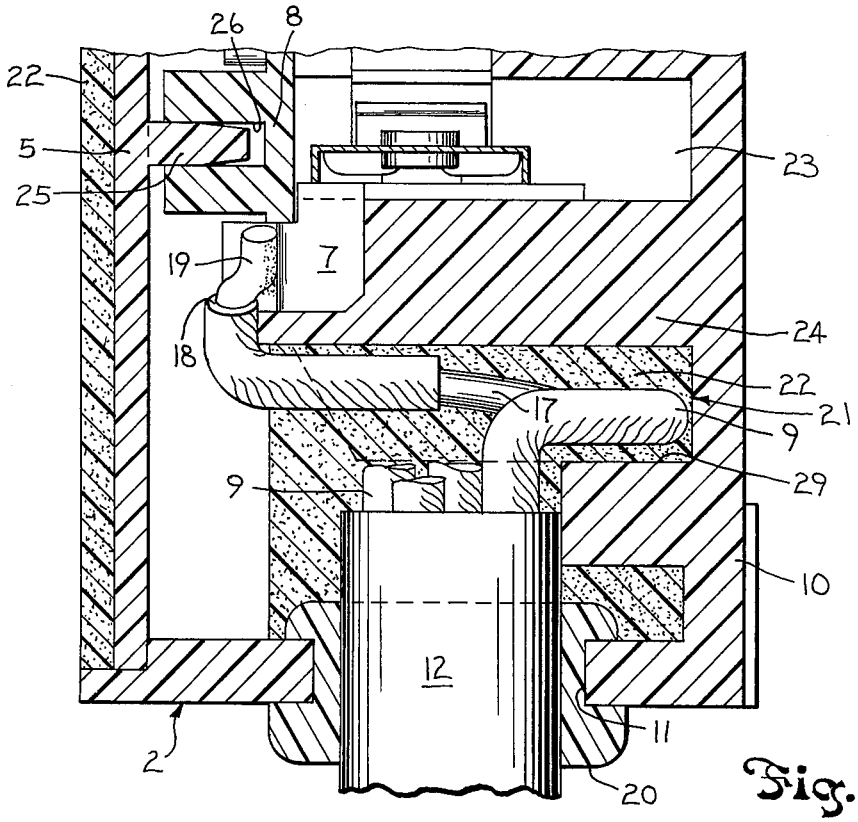
FIG. 5 is a cross-sectional view through the plane 5—5 shown in FIG. 3.

Turning now to FIG. 5 it can be seen that in the preferred embodiment the cover 5 is provided with a projection 25 which cooperates with a projection receiving recess 26 in the cover 8 of the contact block 6 to hold the cover 5 in position. In the preferred embodiment, the cover 5 is sealed in place and completely covered with potting compound to form a fluid-tight seal.

In the embodiment of the invention shown in FIGS. 3, 4 and 5 of the the drawings, the pockets 21A and 21D are formed by the interior of a side wall of the cable receiving section 10, a dividing wall 28 and the underside of the wall 24. The two interior pockets 21B and 21C are formed by the dividing walls 28, the underside of the wall 24 and a bottom wall 29. The shapes of the pockets 21 and the pocket forming walls are not critical as long as they provide the required function of insuring that there is no direct contact between the bare sections 17 of the conductors 9. However, the pocket walls should be of non-conductive material or lined with non-conductive material to eliminate any danger of shorting.

The preferred potting material 22 is a synthetic plastic material, such as an epoxy resin, which flows readily at room temperatures and which cures to form a rigid fluid impervious mass which does not deteriorate under conditions of use. A preferred epoxy resin is ARALDITE which is commercially available from the CIBA Corporation. A wide variety of other potting materials also can be utilized to form the seal. The material should be of a suitable viscosity under conditions of application so that it will flow to completely fill the pockets 21 in the cable receiving section 10 of the housing 2 and form satisfactory fluid-tight seals with the bare sections 17 and the covered sections of the conductors 9 which are within the pockets 21.

In the preferred practice of the invention, the housing 2 is molded of a thermosetting plastic material such as glass filled polyester and the cable receiving section 10 with its pockets 21 is molded integral therewith. However, if desired, the spacer section can be molded separately of a suitable non-conductive material and fitted within a conventional metal housing. In either case, the pockets 21 preferably should be large enough to readily receive the folded portion of an individual conductor 9 and still allow sufficient potting material 22 to flow into intimate direct contact with the stripped portions 17 of the conductors 9 so as to form the necessary fluid-tight seals.

As previously indicated, the housing of the present invention possesses several important advantages. The housing of the present invention not only effectively prevents fluid from traveling through the cable into the switch, but it also prevents fluid from traveling through the individual conductor strands. Furthermore, the novel housing of the present invention permits switch manufacturers to use conventional cable for prewired switches instead of jelly-filled "water blocked" cable and other expensive cables.

Although a preferred embodiment of the invention has been shown and described herein, it will be obvious that various modifications may be made without departing from the spirit of the invention. For example, if desired, the cover of the housing can be a removable cover which is retained in place by fasteners and is rendered fluid-tight by use of a sealing gasket. Therefore, the invention is not intended to be limited by the showing herein or in any other manner except as may be specifically required by the claims.

We claim:

1. A prewired electrical switch including a housing providing a cable seal, said housing having an electrical cable receiving section which includes a plurality of conductor receiving pockets, at least one of said pockets containing a folded portion of an individual electrical conductor, said folded portion including both insulated and uninsulated sections of said conductor, said pocket further containing a non-conductive potting compound which forms fluid-tight seals with the portions of the conductor within the pocket thereby preventing fluid from the outside from traveling along the conductor into the switch.

2. The switch of claim 1 in which the pockets are of a non-conductive material.

3. The switch of claim 1 in which the potting compound is an epoxy resin.

4. A prewired electrical switch which prevents fluid from the outside from entering into the interior of the switch by traveling through an attached electrical cable, which switch includes a housing having a switch contact block containing compartment and a separate electrical cable receiving section, said electrical cable receiving section including a plurality of conductor receiving pockets, at least one of said pockets containing an intermediate length of a conductor, said intermediate length including both insulated and uninsulated sections, said pocket further containing a non-conductive potting compound which forms a fluid-tight seal with that portion of the conductor which is within the pocket thereby preventing fluid from the outside from traveling through the conductor and into the switch contact block containing compartment.

5. The switch of claim 4 in which the pockets have non-conductive walls.

6. The switch of claim 4 in which the potting compound is an epoxy resin.

7. The switch of claim 4 in which the entire switch housing including the cable receiving section is of a non-conductive material.

8. A prewired electrical switch including a housing, having a switch component compartment, switch components including a plurality of electrical terminals positioned in said compartment, an electrical cable receiving section in said housing separate from said switch component compartment, said cable receiving section including a plurality of conductor receiving pockets, a passage leading through the wall of said cable receiving compartment to the outside, a length of electrical cable extending through said passage with a first end of the cable within the cable receiving section of the housing, and the other end outside said housing, said first end of the cable in the cable receiving section being devoid of covering and filler so that lengths of the individual insulator conductors of the cable are exposed, an intermediate portion of at least one of the exposed lengths of conductors being uninsulated, said uninsulated portion being positioned in its own conductor receiving pocket which is filled with a non-conductive potting compound which forms fluid-tight seals with both the insulated and the uninsulated portions of the conductor within the pocket.

9. The switch of claim 8 in which the cable receiving section also contains sufficient potting compound to form a fluid-tight seal with the first end of the cable.

10. The switch of claim 8 in which the portion of the conductor within the pocket is folded.

* * * * *